US012185780B2

(12) United States Patent
Buhaianu

(10) Patent No.: US 12,185,780 B2
(45) Date of Patent: Jan. 7, 2025

(54) METHOD FOR REALISING A GARMENT PROVIDED WITH A BELT TO BE WORN ON THE LOWER LIMBS AND A RELATIVE GARMENT PROVIDED WITH A BELT

(71) Applicant: G.T.A. MODA S.R.L., Selvazzano Dentro (IT)

(72) Inventor: Radu Adrian Buhaianu, Selvazzano Dentro (IT)

(73) Assignee: G.T.A. MODA S.R.L. (IT)

( * ) Notice: Subject to any disclaimer, the term of this patent is extended or adjusted under 35 U.S.C. 154(b) by 0 days.

(21) Appl. No.: 18/573,829

(22) PCT Filed: May 4, 2022

(86) PCT No.: PCT/IB2022/054115
§ 371 (c)(1),
(2) Date: Dec. 22, 2023

(87) PCT Pub. No.: WO2022/269377
PCT Pub. Date: Dec. 29, 2022

(65) Prior Publication Data

US 2024/0260696 A1 Aug. 8, 2024

(30) Foreign Application Priority Data

Jun. 23, 2021 (IT) ..... 102021000016418

(51) Int. Cl.
*A41F 9/02* (2006.01)
*A41D 1/06* (2006.01)
*A41D 1/14* (2006.01)

(52) U.S. Cl.
CPC ..... *A41F 9/02* (2013.01); *A41D 1/06* (2013.01); *A41D 1/14* (2013.01)

(58) Field of Classification Search
CPC ..... A41D 1/06; A41D 1/14; A41F 9/02
See application file for complete search history.

(56) References Cited

U.S. PATENT DOCUMENTS

| | | | | |
|---|---|---|---|---|
| 4,720,874 | A | 1/1988 | Crawford | |
| 9,955,741 | B2 * | 5/2018 | Roup | A41D 27/20 |
| 2010/0192284 | A1 * | 8/2010 | Simon | A41D 1/06 2/243.1 |

FOREIGN PATENT DOCUMENTS

| | | |
|---|---|---|
| FR | 1000639 A | 2/1952 |
| GB | 1463400 A | 2/1977 |
| GB | 2024604 B | 9/1982 |

* cited by examiner

*Primary Examiner* — Gloria M Hale
(74) *Attorney, Agent, or Firm* — Endurance Law Group PLC

(57) ABSTRACT

A garment is provided with a belt to be worn on the lower limbs. The garment is made using a fabric having a longitudinal extension axis. The fabric has a weft direction perpendicular to the longitudinal extension axis, and a warp direction parallel to the longitudinal extension axis. A first plurality of portions of fabric are made by making a first plurality of cut lines having an inclined direction with respect to the weft and warp directions. The inclined direction has an internal angle between 30° and 60° measured with respect to one of the weft or warp directions. The first plurality of portions of fabric are coupled to form a first strip. The first strip is overlapped and fixed to a first elastic strip to form a belt. The belt is fixed to a main body of garment that at least partially covers the lower limbs of a person.

11 Claims, 9 Drawing Sheets

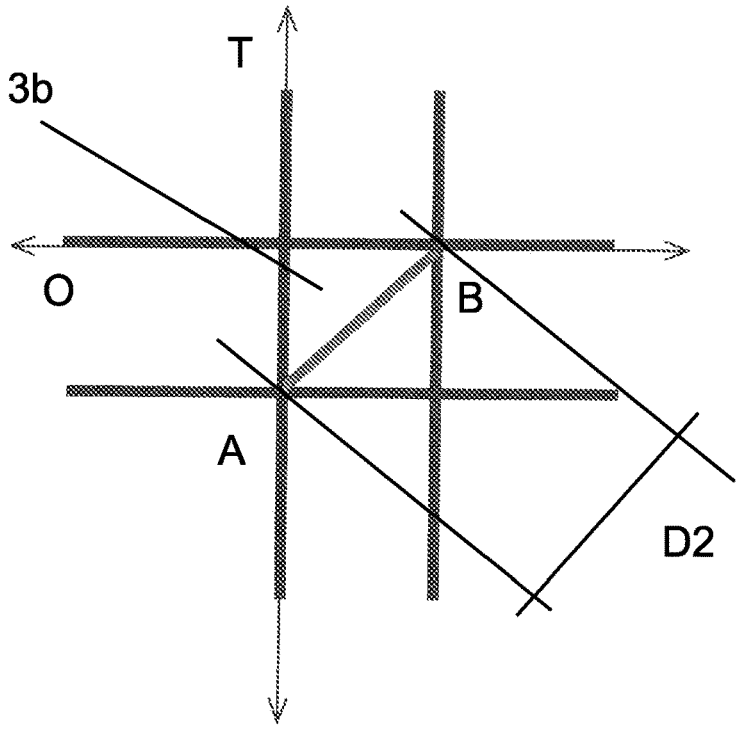
FIG. 3A
FIG. 4A
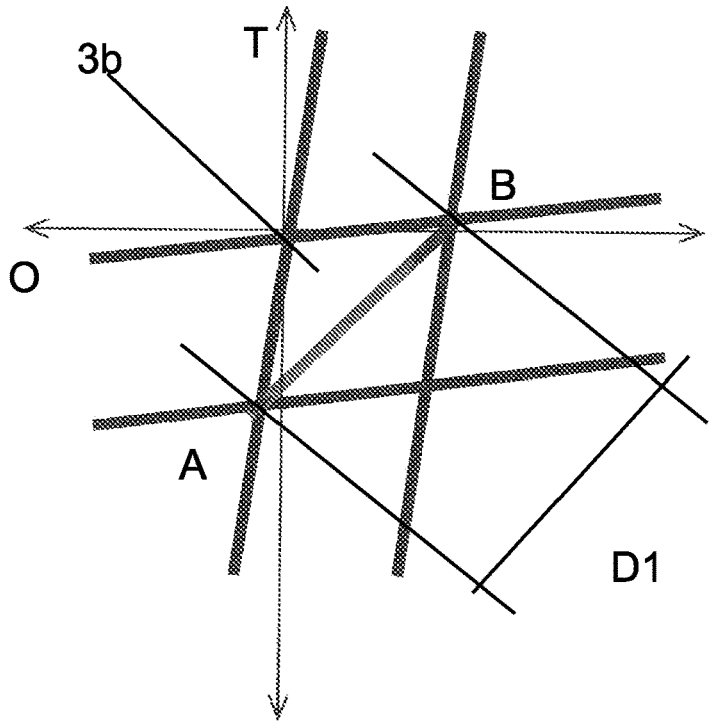

METHOD FOR REALISING A GARMENT PROVIDED WITH A BELT TO BE WORN ON THE LOWER LIMBS AND A RELATIVE GARMENT PROVIDED WITH A BELT

FIELD OF THE INVENTION

The present invention relates to the technical sector concerning articles of clothing.

In particular, the present invention relates to a method for realising a garment provided with a belt to be worn on the lower limbs, and a relative garment provided with a belt.

DESCRIPTION OF THE PRIOR ART

Generally, a garment provided with a belt to be worn on the lower limbs can comprise: a belt comprising a first portion and a second portion of a fabric formed by braided fibres in such a way as to be perpendicular to one another and free of elastic properties, which are overlapped on one another to embrace the waist of a person wearing the garment, when the garment is worn; a main body conformed to at least partially cover the lower limbs of a person wearing the garment, when the garment is worn.

However, the garment can be uncomfortable, due to the fact that the belt, being without elastic properties, can pinch the waist of the wearer, in particular during movement, when the wearer assumes bent positions, or when seated, when relaxed positions are taken up.

Further, the garment with pockets do not respond to the needs of the clientele which, owing to the physical shape thereof, would require garment sizes that differ from the part surrounding the waist and from the part that at least partially covers the lower limbs: in fact, in this case, a garment of this type, when worn, can dress well but pinch the waist.

In order to obviate the problem, there is often the tendency to purchase a larger-fitting garment in order to avoid the perceptible tightness in the waist.

The above-mentioned drawbacks are obviated by a known garment provided with a belt (100) to be worn on the lower limbs, FIG. 1 illustrates a known pair of trousers provided with a belt (100), by way of example, but reference might also be made to a skirt with pockets, comprising: a belt (101) which is made of a fabric formed by fibres braided in such a way as to be perpendicular to one another and free of elastic properties and internally comprising an elastic strip (102); a main body (103) which forms the legs of the trousers. The elastic strip (102) and the cloth constituting the belt (101) are fixed to one another by a seam (106), which is realised by maintaining the elastic strip (102) extended so that, once the seam (106) has been realised and the elastic strip (102) released, the cloth constituting the belt (101), and which covers the elastic strip (102), ruffles up on the elastic strip (102).

In detail, the belt (101) comprises a first portion (101*a*) and a second portion (101*b*) which are overlapped on one another and between which the elastic strip (102) is arranged.

Therefore the seam (106) fixes the first portion (101*a*) and the second portion (101*b*) of the belt (101) and the elastic strip (102) to one another.

It follows that, at the moment in which the known garment provided with a belt (100) is worn, the extension of the belt (101) is limited to the portion of ruffled material between one fixing point and the following of the seam (106).

Therefore, as the seam (106) fixes the first portion (101*a*) and the second portion (101*b*) of belt (101) and the elastic strip (102) to one another, there is no way to best exploit the elastic properties of the elastic strip (102) itself.

In other words, with the known garment provided with a belt (100) there is no way to exploit the elastic properties of the elastic strip (102) and this also makes the known pair of trousers provided with a belt (100) uncomfortable.

A further drawback of the known trousers provided with a belt (100) is relative to an aesthetic factor, as the material of the belt (101) is ruffled and this aspect tends to categorise the known trousers provided with a belt (100) as a pair of sports pants.

In the light of the above, the aim of the present invention consists in obviating the drawbacks of the prior art.

SUMMARY OF THE INVENTION

The above aim is attained with a method for realising a garment provided with a belt to be worn on the lower limbs, according to claim 1 and with a garment provided with a belt to be worn on the lower limbs, according to claim 8.

The portions of fabric of the first plurality of portions of fabric, which will be coupled to conform the first strip of the belt, are advantageously realised by making cut lines having an inclined direction with respect to the weft direction and to the warp direction: in this way, the portions of fabric include an arrangement of the braided fibres, which constitute the fabric itself, that is inclined with respect to the cut lines and is such as to allow a partial closure of the openings which define the net structure of the fabric, at the moment of the application of a traction force at the sides of the cut portion of fabric and along the cut line. A deformation of the portion of fabric follows, i.e. an extension in length of the portion of fabric, while using a fabric formed by fibres free of elastic properties. Further, the overlapping and the fixing of the first elastic strip and the first strip to one another enables obtaining a belt that is such as to return to a rest position, when not subject to the traction force: in other words, the belt of the garment of the present invention is of such a type as to lengthen, following the action of a traction force, because of the cutting method of the portions of fabric of the first plurality of portions of fabric which define the first strip and is such as to shorten, when the action of the traction force is interrupted, owing to the first elastic strip.

This produces a garment provided with a belt that is such as to ensure a reversible deformation of the relative belt.

BRIEF DESCRIPTION OF THE DRAWINGS

Specific embodiments of the invention will be described in the following part of the present description, according to what is set down in the claims and with the aid of the accompanying tables of drawings, in which:

FIGS. 3A and 4A are views of details W and K, respectively of FIGS. 3 and 4;

DESCRIPTION OF THE PREFERRED EMBODIMENTS

Figure 1:
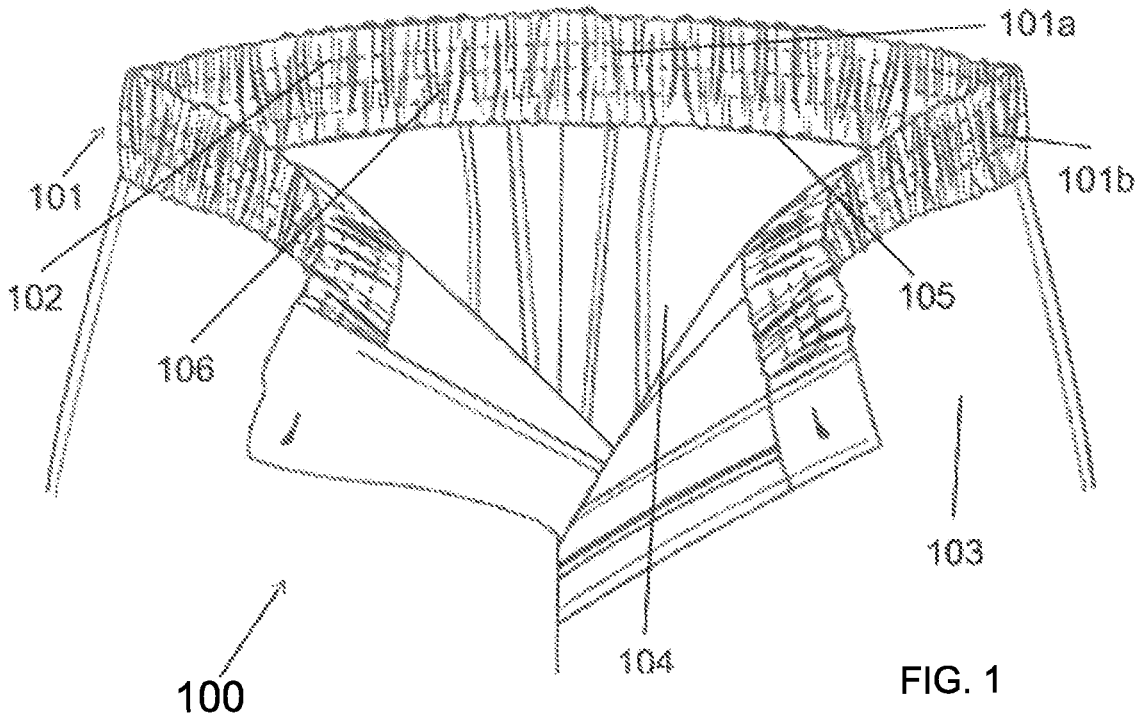
FIG. 1 is a schematic view of the known garment provided with a belt to be worn on the lower limbs.

With reference to the appended tables of drawings, a method is described in the following for realising a garment provided with a belt (1) to be worn on the lower limbs, object of the present invention, comprising steps of (which can be carried out not necessarily in the order given):

- having available a fabric (3) having a longitudinal extension axis (L);
- the fabric (3) being formed by fibres braided in such a way as to be perpendicular to one another and free of elastic properties;
- defining a weft direction (T) of the fabric (3), which weft direction (T) is perpendicular to the longitudinal extension axis (L);
- defining a warp direction (O) of the fabric (3), which warp direction (O) is parallel to the longitudinal extension axis (L);
- cutting a first plurality of portions of fabric (4) by making a first plurality of cut lines (5) having an inclined direction (I) with respect to the weft direction (T) and the warp direction (O);
- each cut line (5*a*) of the first plurality of cut lines (5) having an inclined direction (I) by an internal angle, with the weft direction (T) or the warp direction (O), comprised between 30° and 60°;
- coupling the portions (4*a*) of the first plurality of portions of fabric (4) to form a first strip (6);
- having available a first elastic strip (7);
- overlapping and fixing the first strip (6) and the first elastic strip (7) to one another so as to realise a belt (8);
- cutting a main body (9) conformed to at least partially cover the lower limbs of a person wearing the garment (1), when the garment (1) is worn;
- fixing the belt (8) and the main body (9) to one another.

The garment (1) can be a pair of trousers.

Alternatively, the garment (1) can be a skirt (not illustrated).

FIGS. 12-15 illustrates a garment (1) in the form of a pair of trousers.

The fabric (3) can be made of natural fibres or vegetal or synthetic fibres.

The fabric (3) can be a fabric formed by fibres free of elastic properties.

In other words, the fibres can be non-elastic fibres.

The fabric (3) can be defined as a woven fabric.

Further, the fibres of the fabric (3) can be braided to one another in such a way as to prevent a relative reversible deformation.

Figure 2:
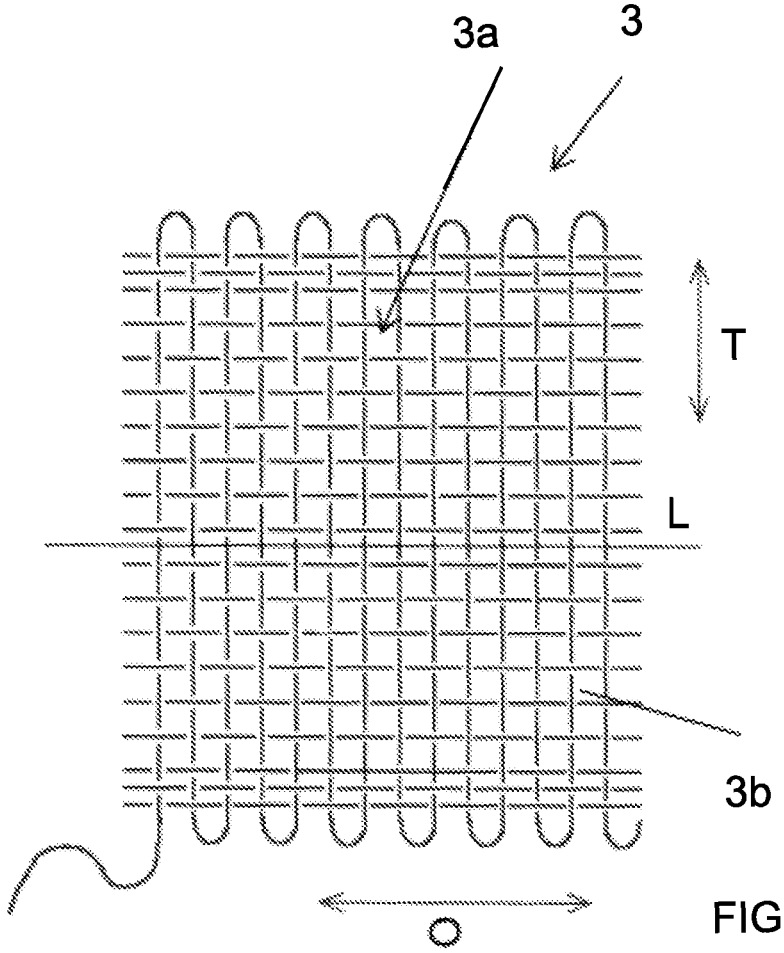
FIG. 2 is a schematic view of the braided fibres of the fabric.

The fibres constituting the fabric (3) can extend along the weft direction (T) and along the warp direction (O) (see FIG. 2).

In other words, the fibres of the fabric (3) which extend along the weft direction (T) are without elastic properties.

Likewise, the fibres of the fabric (3) which extend along the warp direction (O) are without elastic properties.

By way of example, the fabric (3) can be made of cotton or wool or gabardine or the like.

FIG. 2 is a larger view of the fabric (3), in which a net structure (3*a*) is visible, having openings (3*b*).

Further, FIG. 2 also illustrates the weft direction (T), the warp direction (O) and the longitudinal extension axis (L).

The step of coupling the portions of fabric (4*a*) of the first plurality of portions of fabric (4) can include sewing the portions of fabric (4*a*) to one another to form the first strip (6).

The first strip (6) can be conformed in such a way as to embrace the waist of a person wearing the garment (1), when the garment (1) is worn.

The step of overlapping the first strip (6) and the first elastic strip (7) can be done in such a way as to overlap them to define a planar extension.

The belt (8) can be conformed in such a way as to embrace the waist of a person wearing the garment (1), when the garment (1) is worn.

The main body (9) can be obtained from the fabric (3) by cutting a second plurality of portions of fabric (11).

In detail, by cutting the fabric (3) into the first plurality of portions of fabric (4) a remaining part of fabric (3) will be obtained.

The method can comprise a step of cutting the remaining part of fabric (3) into the second plurality of portions of fabric (11).

The portions of fabric (11*a*) of the second plurality of portions of fabric (11) can be coupled to one another to define the main body (9).

The portions of fabric (11*a*) of the second plurality of portions of fabric (11) can be dimensioned so as to define the main body (9).

Alternatively, the main body (9) can be obtained from a second fabric (12), which is different to the first fabric (3).

The second fabric (12) can be a fabric formed by fibres having elastic properties.

By way of example, the second fabric (12) can have synthetic fibres.

The synthetic fibres can be of the Spandex type.

The second fabric (12) can be a stretch-type fabric, i.e. having elastic synthetic fibres which extend along the weft direction (T) or along the warp direction (O).

Alternatively, the second fabric (12) can be a bi-stretch type fabric, i.e. having elastic synthetic fibres which extend along the weft direction (T) and warp direction (O).

In detail, in the case in which the garment (1) is a pair of trousers, the main body (9) can form the legs of the trousers (see FIGS. 12-15).

The belt (8) can comprise a first end (8*a*) and a second end (8*b*).

The step of fixing the belt (8) and the main body (9) to one another can include fixing the belt (8) and the main body (9) at the second end (8*b*) of the belt (8).

In this case, the fastening can be done by making a seam line (13).

Figure 3:
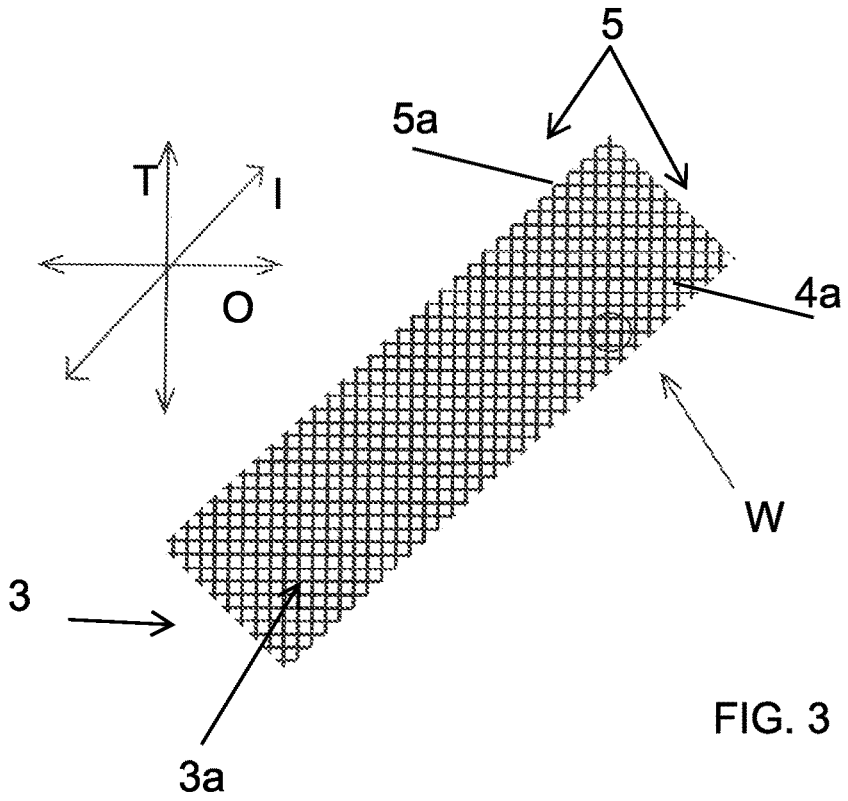
FIG. 3 and FIG. 4 are views of a portion of fabric of the first plurality of portions of fabric, respectively in a rest condition and in an extension condition.
Figure 4:
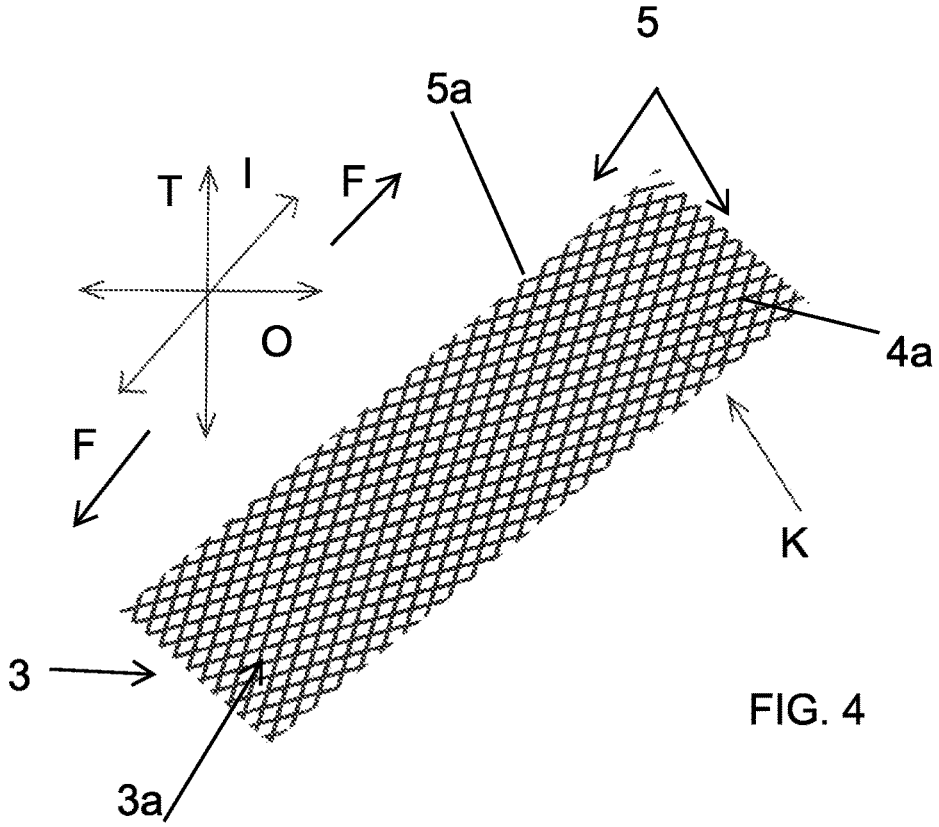

FIGS. 3 and 4 schematically illustrate a portion of fabric (4*a*) of the first plurality of portions of fabric (4), and the weft (T) direction and warp direction (O) of the fabric (3), in the condition, respectively, of rest and extension.

It is specified that by rest condition it is meant that the portion of fabric (4*a*) is not subjected to a traction force; while by extension condition it is meant that the portion of fabric (4*a*) is subjected to a traction force (F) along the inclined direction (I).

FIGS. 3A and 4A illustrate detail W and detail K, respectively of FIGS. 3 and 4 and points A and B are denoted as two general intersection points between a fibre of fabric (3) which extends along the weft direction (T) and a fibre of fabric (3) which extends along the warp direction (O).

By comparing FIGS. 3A and 4A it can be observed that in the extension condition the distance (D1) between points A and B is greater than the distance (D2) between points A and B in the rest condition.

In other words, the fabric (3), by dint of its conformation, includes a net structure (3*a*) having openings (3*b*).

By applying a traction force (F) along the inclined direction (I) there is a partial closure of the openings (3*b*) of the net structure (3*a*) so as to enable a deformation of the fabric (3) itself: in fact, this deformation enables obtaining an extension in length of the portion of fabric (4*a*) during the application of the traction force (F).

To demonstrate the above description, the inventors carried out tests on portions of fabric made of cotton.

These tests were conducted by simulating a traction force (F) of 100 gf/cm (grams force/centimetre) at two sides of a predetermined portion of fabric (4*a*) made of cotton, by means of a FAST dynamometer.

In detail, the tests were conducted on the same portion of fabric (4*a*), the traction force (F) along the weft direction (T), along the warp direction (O) and along the inclined direction (I) with a value of 30°, 45° and 60°.

The tests demonstrated that: the extension percentage, in the case in which the traction force (F) is applied along the weft direction (T) is 1%; the extension percentage, in the case in which the traction force (F) is applied along the warp direction (O) is 2.6%; the extension percentage, in the case in which the traction force (F) is applied along the inclined direction (I) of 30° is 4.5%; the extension percentage, in the case in which the traction force (F) is applied along the inclined direction (I) of 45° is 5.4%; the extension percentage, in the case in which the traction force (F) is applied along the inclined direction (I) of 60° is 5.2%.

The step of fixing the first strip (6) and the first elastic strip (7) to one another preferably includes gluing the first strip (6) and the first elastic strip (7) to one another.

In this case the first elastic strip (7) can have thermo-adhesive properties.

A stable fixing is advantageously ensured between the first strip (6) and the first elastic strip (7), so as to guarantee the properties of reversible deformation of the belt (8), including for varied uses of the garment provided with a belt (1).

Alternatively, the step of fixing the first strip (6) and the first elastic strip (7) to one another can include sewing them together (not illustrated).

Figure 7:
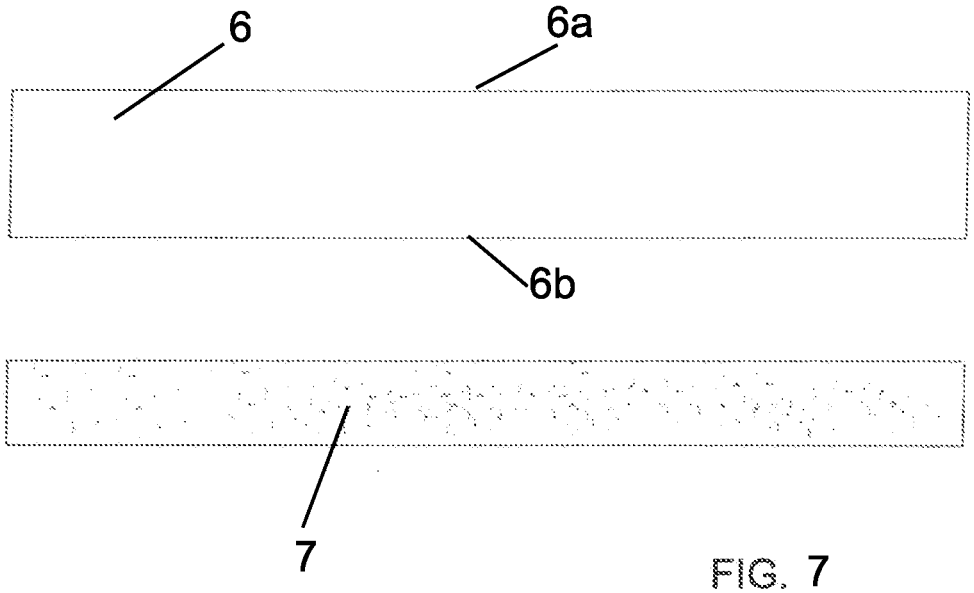
FIGS. 7-11 are views of some of the steps of the method of the present invention.
Figure 8:
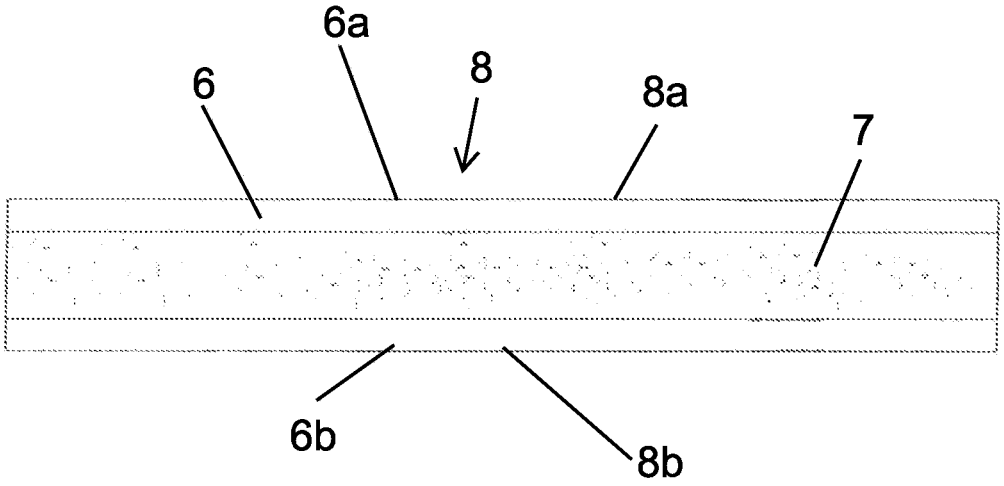
Figure 9:
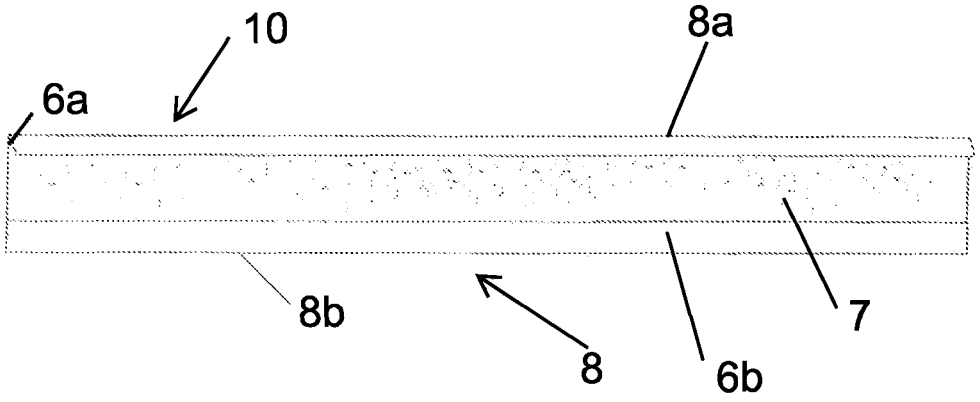

In detail, with particular reference to FIGS. 7-9, the first strip (6) and the first elastic strip (7) can be overlapped on one another so that the first elastic strip (7) is positioned centrally with respect to the first strip (6) (see FIG. 8).

Thereafter, a first edge (6*a*) of the first strip (6) is folded on the first elastic strip (7), realising a first overlap zone (10) (see FIG. 9).

The method can comprise steps of:

having available a second elastic strip (14);

overlapping on and fixing the second elastic strip (14) and the belt (8) to one another.

The second elastic strip (14) advantageously guarantees support to the reversible deformation of the belt (8), once the garment (1) is worn.

The second elastic strip (14) and the belt (8) can be fixed to one another at the first end (8*a*) of the belt (8).

Figure 11:
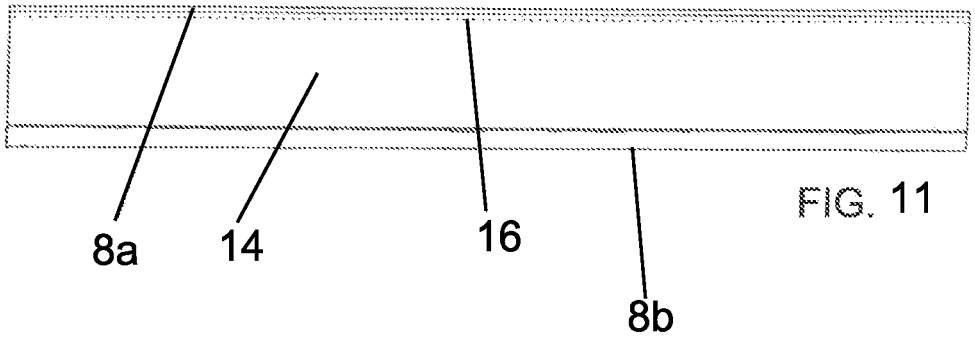

FIG. 11 illustrates the belt (8) comprising the first strip (6), the first elastic strip (7) and the second elastic strip (14) overlapped and fixed to one another.

FIGS. 12-15 illustrate the belt (8) once assembled to the main body (9).

Figure 12:
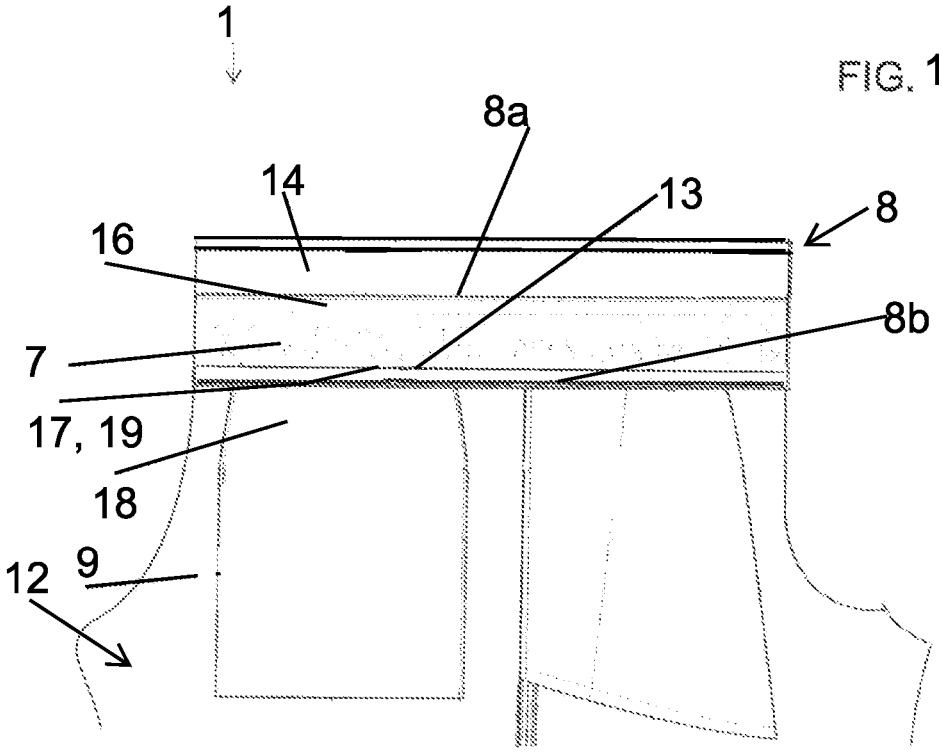
FIGS. 12 and 13 are views of the garment provided with a belt object of the present invention, taken from two different sides, according to an embodiment thereof.

In detail, with reference to FIGS. 11 and 12, the belt (8) and the main body (9) are fixed to one another at the first edge (6*a*) of the first strip (6).

The step of fixing the second elastic strip (14) and the belt (8) to one another preferably includes sewing the second elastic strip (14) and the belt (8) to one another, realising a second seam line (16).

Likewise, the step of fixing the main body (9) and the belt (8) to one another can include sewing the main body (9) and the first strip (6) to one another, realising a third seam line (17).

The second seam line (16) can be a linear seam realised with an elasticated thread.

A fastening is advantageously obtained between the two portions having elastic properties, also having elastic properties.

The elasticated thread can be a polyester multifilament thread, having an elongation at break of up to 70%.

The third seam line (17) can be realised with an elasticated thread.

In particular, the third seam line (17) can be realised with an elasticated thread when the main body (9) is obtained from the second fabric (12), according to the embodiment in which the second fabric (12) is of the stretch or bi-stretch type.

Figure 10:
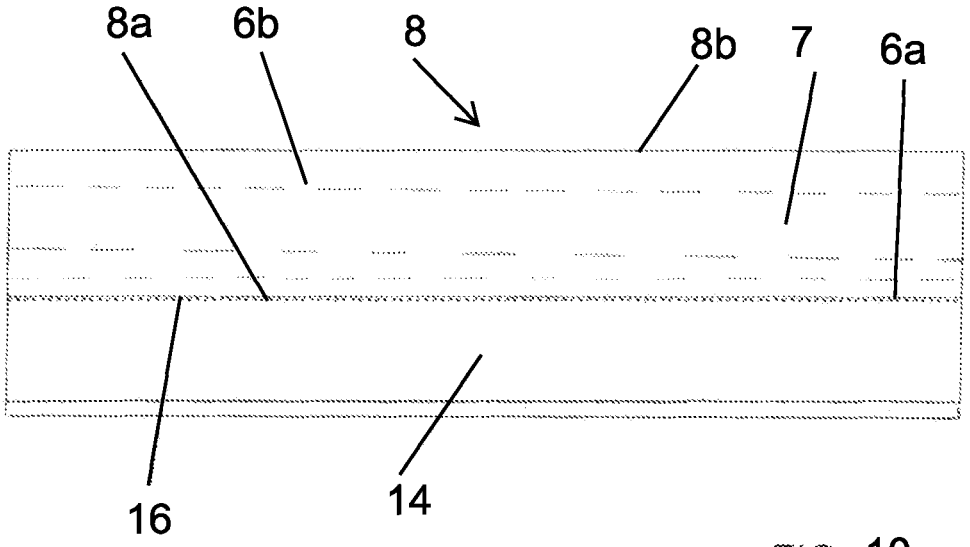

In detail, with reference to FIG. 10, the second elastic strip (14) and the belt (8) are fixed to one another at the first overlap zone (10) by the second seam line (16).

The method can comprise steps, which can be carried out not necessarily following what is described in the foregoing of:

having available at least a pocket lining (18);

fixing the at least a pocket lining (18), the main body (9) and the belt (8) to one another.

It is advantageously possible to realise a garment provided with a belt (1) with pockets.

In the case in which the garment provided with a belt (1) is a pair of trousers, it is possible to realise trousers with pockets (see FIGS. 12-15).

The at least a pocket lining (18) can be realised in the fabric (3).

In this case, the at least a pocket lining (18) can be realised by cutting a third plurality of portions of fabric by making a third plurality of cut lines having an inclined direction (I) with respect to the weft direction (T) and the warp direction (O) and each cut line of the third plurality of cut lines has an inclined direction (I) of an internal angle, with the weft direction (T) or the warp direction (O), comprised between 30° and 60° (not illustrated).

Alternatively, the at least a pocket lining (18) can be realised in the second fabric (12).

The step of fixing the at least a pocket lining (18), the main body (9) and the belt (8) to one another can include sewing the at least a pocket lining (18), the main body (9) and the belt (8) to one another realising a fourth seam line (19).

In detail, a seam is made to fasten to one another the at least a pocket lining (18) and the main body (9) and, thereafter, a seam is made to fasten to one another the at least a pocket lining (18) and the main body (9), already fixed to one another, and the belt (8).

The step of fixing the at least a pocket lining (18) and the belt (8) to one another can include fastening the at least a pocket lining (18) and the belt (8) at the second end (8*b*) of the belt (8) in such a way that the at least a pocket lining (18) and the main body (9) are at least partially overlapped on one another.

According to this embodiment, the fourth seam line (19) can fix the belt (8), the second elastic strip (14), the at least a pocket lining (18) and the main body (9) to one another.

The fourth seam line (19) can be realised with an elasticated thread like the one described in the foregoing.

In this way, a like translation of the belt (8) is ensured at the first end (8*a*) and the second end (8*b*).

Figure 13:
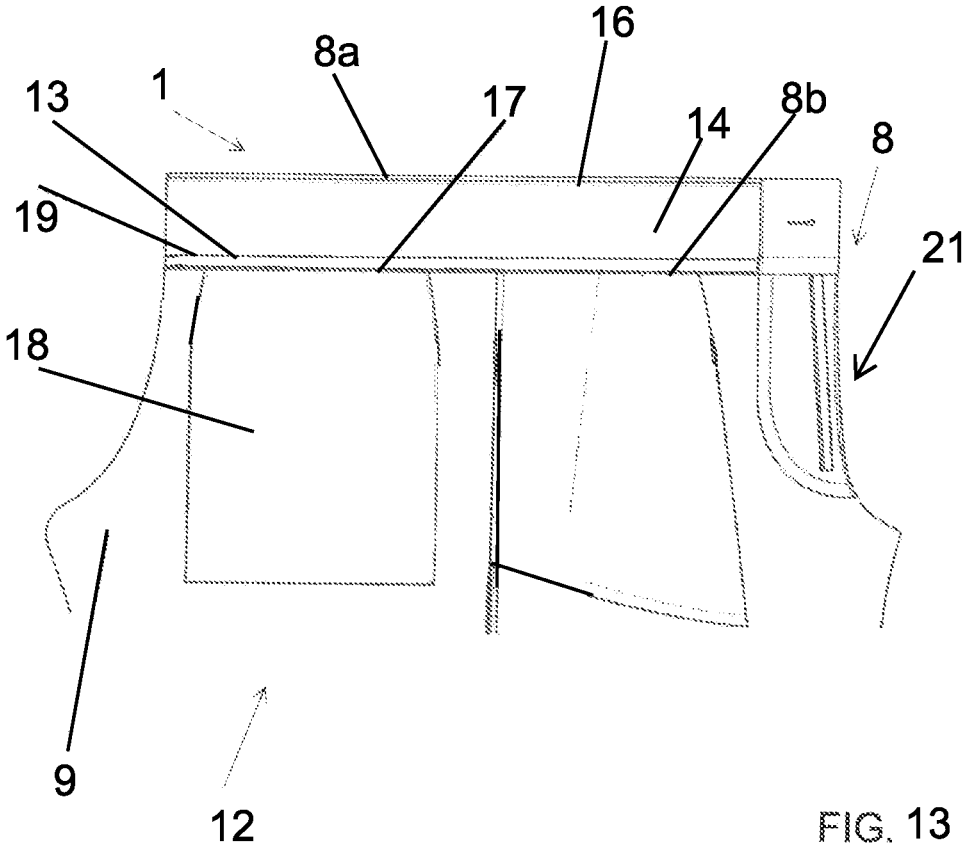

FIGS. 12 and 13 illustrate two views of the garment (1) obtained according to the steps of the described method, according to the present embodiment.

For greater clarity, FIG. 12 illustrates the belt (8) assembled to the main body (9) in a configuration in which the second elastic strip (14) is raised with respect to the belt (8); while FIG. 13 illustrates the belt (8) assembled to the main body (9) in a configuration in which the second elastic strip (14) is folded on the belt (8).

The at least a pocket lining (18) can have a degree of elasticity having a first value; the fabric (3) has a degree of elasticity having a second value; the first value is lower than the second value.

The method can further comprise steps, which can be carried out not necessarily following what is described in the foregoing of:

- positioning an additional cloth (20) between the at least a pocket lining (18) and the belt (8) in such a way that the additional cloth (20) and the main body (9) are at least partially overlapped on one another;
- the additional cloth (20) and the fabric (3) having the same degree of elasticity;
- fixing the additional cloth (20) and the belt (8) to one another;
- fixing the at least a pocket lining (18), the main body (9) and the additional cloth (20) to one another.

In a case in which the belt (8) and the at least a pocket lining (18) have a degree of elasticity value that are different to one another, the additional cloth (20) having the same degree of elasticity value as the belt (8) advantageously ensures a same extension of the first end (8*a*) and the second end (8*b*) of the belt (8).

The additional cloth (20) can be realised in the fabric (3).

In this case, the additional cloth (20) can be realised by cutting a fourth plurality of portions of fabric making a fourth plurality of cut lines having an inclined direction (I) with respect to the weft direction (T) and the warp direction (O) and each cut line of the third plurality of cut lines has an inclined direction (I) of an internal angle, with the weft direction (T) or the warp direction (O), comprised between 30° and 60° (not illustrated).

Alternatively, the additional cloth (20) can be realised in the second fabric (12).

The step of fixing the additional cloth (20), the main body (9) and the belt (8) to one another can include sewing the additional cloth (20), the main body (9) and the belt (8) to one another.

In detail, is a seam is made to fasten to one another the additional cloth (20) and the main body (9) and, thereafter, a seam is made to fasten to one another the additional cloth (20) and the main body (9), already fixed to one another, and the belt (8).

The step of fixing the at least a pocket lining (18) and the additional cloth (20) to one another can include sewing the at least a pocket lining (18) and the additional cloth (20) to one another.

Figure 14:
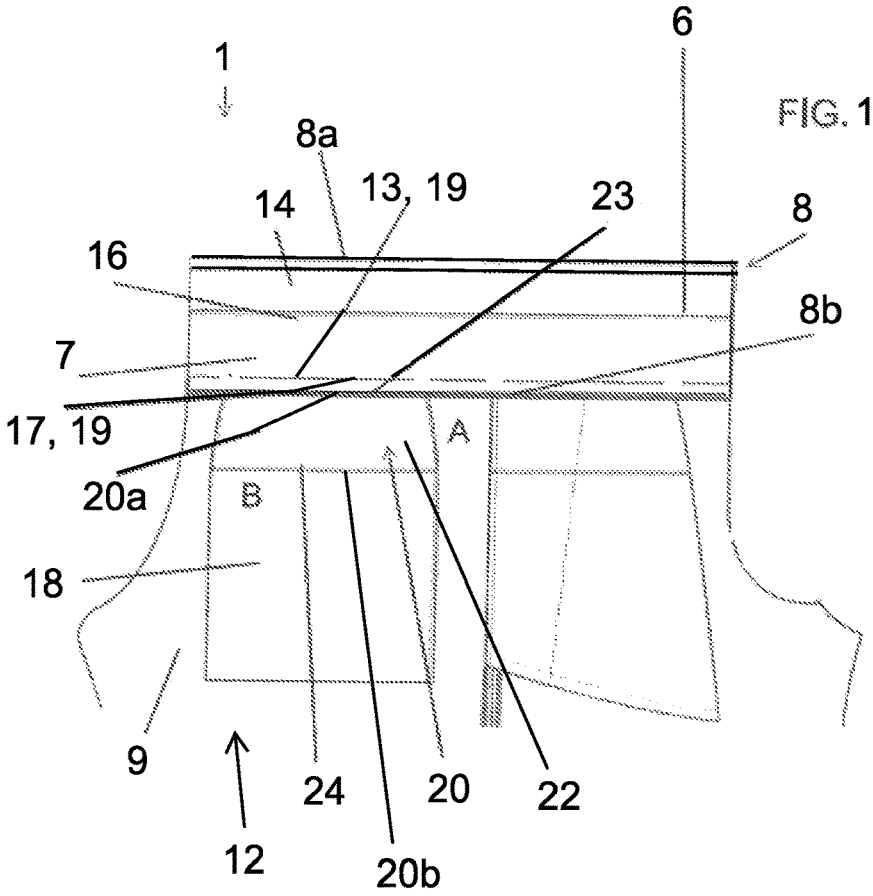
FIGS. 14 and 15 are views of the garment provided with a belt object of the present invention, taken from two different sides, according to a further embodiment thereof.
Figure 15:
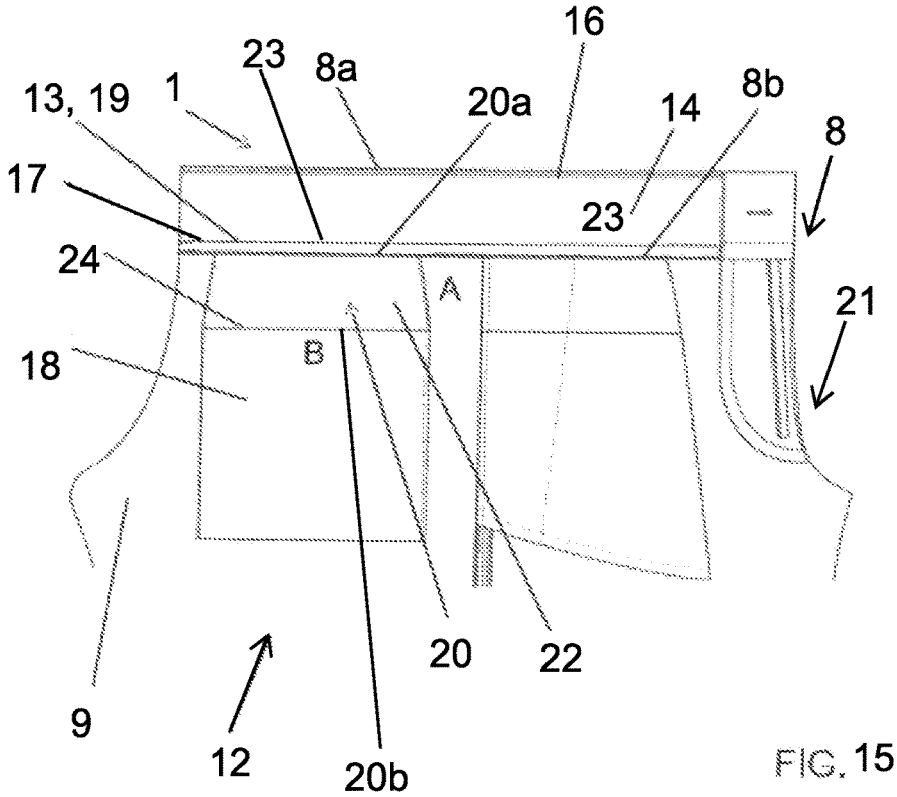

FIGS. 14 and 15 illustrate two views of the garment provided with a belt (1) obtained according to the steps of the described method, in accordance with this further embodiment of the invention.

For greater clarity, FIG. 14 illustrates the belt (8) assembled to the main body (9) in a configuration in which the second elastic strip (14) is raised with respect to the belt (8); while FIG. 15 illustrates the belt (8) assembled to the main body (9) in a configuration in which the second elastic strip (14) is folded on the belt (8).

Further, the seams, which fix the additional cloth (20) and the belt (8) to one another and the additional cloth (20) and the at least a pocket lining (17) to one another, are set away from one another so as to define a portion of additional cloth (22) between them, so that, during the extension of the belt (8), when the garment (1) is worn, the part of additional cloth (20) at the seam line which fixes the additional cloth (20) and the belt (8) to one another is drawn in extension.

Figure 5:
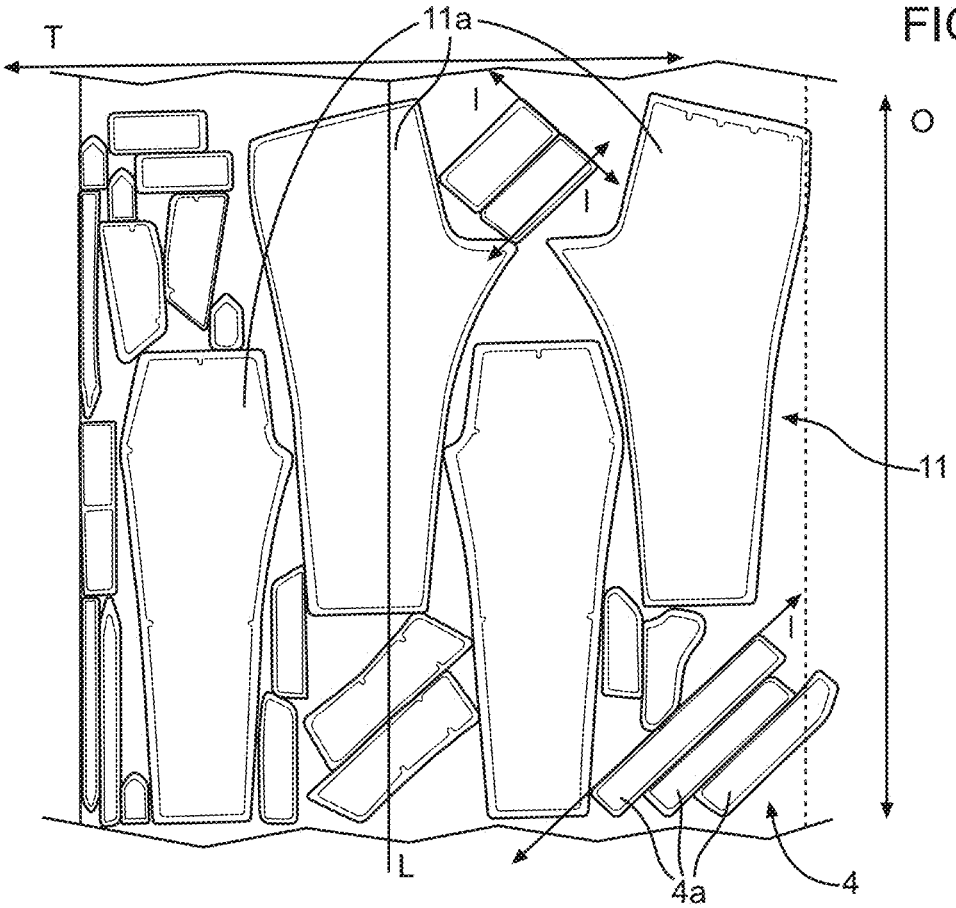
FIGS. 5 and 6 are schematic views which illustrate the portions of fabric of the first and second plurality of portions of fabric which define a garment in the form of a pair of trousers.
Figure 6:
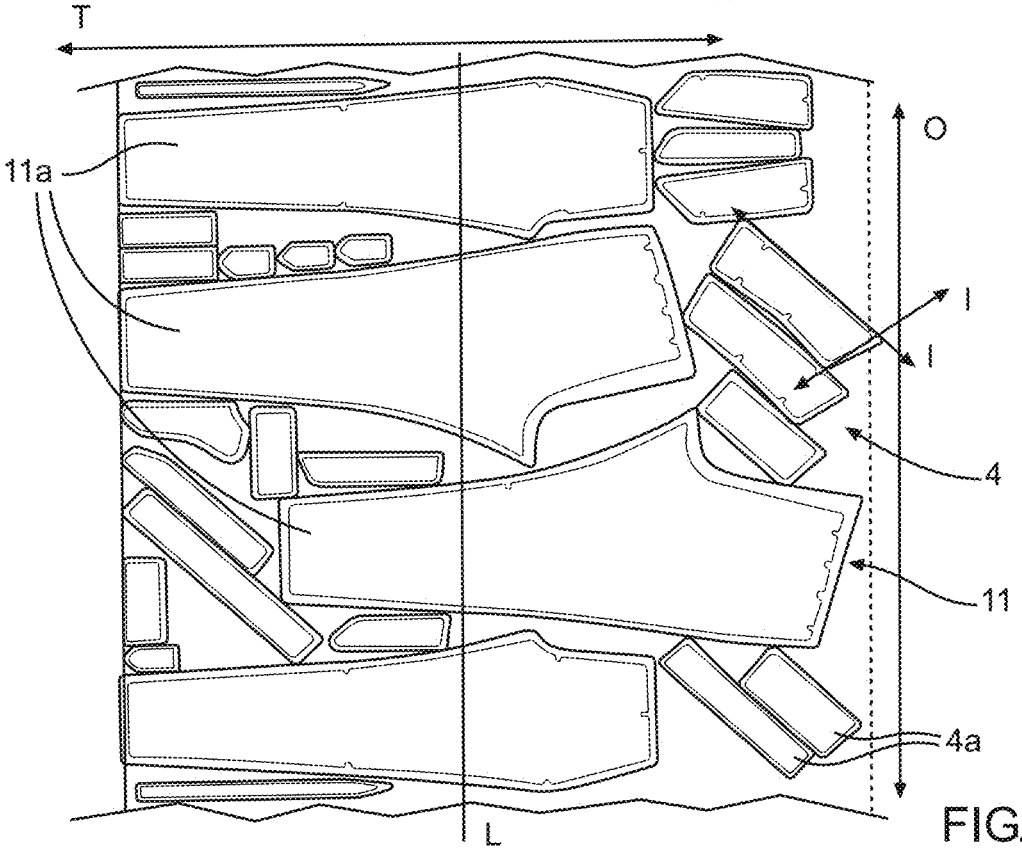

With reference to FIGS. 5 and 6, FIG. 5 illustrates the portions of fabric (4*a*, 11*a*) of the first and second plurality of portions of fabric (4, 11), which define a garment in the form of a pair of trousers, starting from a portion of fabric (3) having a predetermined longitudinal extension (L).

In FIG. 5, the portions of fabric (11*a*) of the second plurality of portions of fabric (11) have an extension along the warp direction (O).

In the same way, FIG. 6 illustrates the portions of fabric (4*a*, 11*a*) of the first and second plurality of portions of fabric (4, 11), which define a garment in the form of a pair of trousers, starting from a portion of fabric (3) having a predetermined longitudinal extension (L).

Differently to FIG. 5, in FIG. 6, the portions of fabric (11*a*) of the second plurality of portions of fabric (11) have an extension along the weft direction (T).

In both FIGS. 5 and 6 it can be observed that the portions of fabric (4*a*) of the first plurality of portions of fabric (4) have a polygonal shape and the relative sides extend along the inclined direction (I).

The following is a description of a garment provided with a belt (1) obtainable with the above-described method, also object of the present invention, comprising:

- a first plurality of portions of fabric (4) which are obtained from a fabric (3) having a longitudinal extension axis (L) and being formed by braided fibres in such a way as to be perpendicular to one another and free of elastic properties;
- the first plurality of portions of fabric (4) having a first plurality of cut lines (5) in turn having an inclined direction (I) of an internal angle, with the weft direction (T) or the warp direction (O), comprised between 30° and 60° and which are coupled to one another so as to define a first strip (6);
- a first elastic strip (7);
- the first strip (6) and the first elastic strip (7) being overlapped on one another and fixed to one another so as to realise a belt (8);
- a main body (9) conformed to at least partially cover the lower limbs of a person wearing the garment (1), when the garment (1) is worn; the belt (8) and the main body (9) being fixed to one another.

The garment provided with a belt (1) can be obtained with the steps of the method as described in the foregoing.

Further, the belt (8) can be provided with blocking means (21) in order to block the belt (8) to the waist of the person wearing the garment (1).

The garment provided with a belt (1) can comprise a second elastic strip (14); the second elastic strip (14) and the belt (8) are overlapped on one another.

Further, the garment provided with a belt (1) can comprise at least a pocket lining (18); the at least a pocket lining (18), the main body (9) and the belt (8) can be fixed to one another.

The at least a pocket lining (18) may have a degree of elasticity having a first value and the fabric (3) may have a degree of elasticity having a second value; the first value is lower than the second value.

In this case, the garment provided with a belt (1) can comprise: an additional cloth (20) arranged between the at least a pocket lining (18) and the belt (8) in such a way that the additional cloth (20) and the main body (9) are at least partially overlapped on one another; the additional cloth (20), the main body (9) and the belt (8) being fixed to one another; the at least a pocket lining (18) and the additional cloth (20) being fixed to one another.

The garment provided with a belt (1) comprises: a seam line (13) arranged so as to fix the belt (8) and the main body (9) to one another; a second seam line (16) arranged to fix the second elastic strip (14) and the belt (8) to one another.

In detail, with particular reference to FIGS. 12-15, the additional cloth (20) and the at least a pocket lining (18) extend along the length of a leg of the garment provided with a belt (1), starting from the belt (8).

The garment with pockets (1) can comprise a fifth seam line (23) arranged to fix the additional cloth (20) and the belt (8) to one another and a sixth seam line (24) arranged to fix the additional cloth (20) to one and the at least a pocket lining (18) to one another.

The fifth seam line (23) and the sixth seam line (24) are set away from one another so as to define a portion of additional cloth (22) between them, so that, during the extension of the belt (8), when the garment (1) is worn, the part of additional cloth (20) at the seam line which fixes the additional cloth (20) and the belt (8) to one another is drawn in extension.

By way of example, the fifth seam line (23) and the sixth seam line (24) are seam lines of chain stitches. In this way, the fifth seam line (23) and the sixth seam line (24) are uniform.

Alternatively, the fifth seam line (23) and the sixth seam line (24) can be linear seam lines made using an elasticated thread.

By way of example, the elasticated thread can be a polyester multifilament thread, having an elongation at break of up to 70%.

The additional material (20) can comprise a first edge (20*a*) and a second edge (20*b*) opposite one another and parallel to the first edge (20*a*); the fifth seam line (23) is arranged along the first edge (20*a*); the sixth seam line (24) is arranged along the second edge (20*b*) (see FIGS. 14 and 15).

The additional cloth (20) can define a quadrilateral having a relative base (B) equal to at least double the relative height (A).

It has been demonstrated that the additional cloth (20) can advantageously be realised according to this proportion also for different sizes of the garment provided with a belt (1).

The first edge (20*a*) or the second edge (20*b*) of the additional cloth (20) can define the base (B) of the quadrilateral.

The additional cloth (20), the main body (9) and the first strip (6) can preferably be made of the same fabric (3).

The invention claimed is:

1. A method for realizing a garment provided with a belt to be worn on a person having lower limbs, comprising steps of:

having available a fabric having a longitudinal extension axis;

the fabric being formed by fibers braided in such a way as to be perpendicular to one another and free of elastic properties;

defining a weft direction (T) of the fabric which weft direction (T) is perpendicular to the longitudinal extension axis;

defining a warp direction (0) of the fabric which warp direction (0) is parallel to the longitudinal extension axis;

cutting the fabric in a first plurality of portions of fabric by making a first plurality of cut lines having an inclined direction (I) with respect to the weft direction (T) and the warp direction (0);

each cut line of the first plurality of cut lines having an inclined direction (I) of an internal angle, with the weft direction (T) or the warp direction (0), comprised between 30° and 60°;

coupling the portions of the first plurality of portions of fabric to form a first strip;

having available a first elastic strip;

overlapping and fixing the first strip and the first elastic strip to one another so as to realise realize a belt;

cutting a main body conformed to at least partially cover the lower limbs of a person wearing the garment, when the garment is worn;

fixing the belt and the main body to one another.

2. The method of claim 1, wherein the step of fixing the first strip and the first elastic strip to one another includes gluing the first strip and the first elastic strip to one another.

3. The method of claim 2, further including the steps of:

having available a second elastic strip;

overlapping on and fixing the second elastic strip and the belt to one another.

4. The method of claim 3, wherein the step of fixing the second elastic strip and the belt to one another includes sewing the second elastic strip and the belt to one another, realizing a second seam line.

5. The method of claim 4, wherein the second seam line is a linear seam realized with an elasticated thread.

6. The method of claim 1, further including the steps of:

having available at least a pocket lining;

fixing the at least a pocket lining, the main body and the belt to one another.

7. The method of claim 6, wherein: the at least a pocket lining has a degree of elasticity having a first value; the fabric has a degree of elasticity having a second value; the first value is lower than the second value;

the method comprises steps of:

positioning an additional cloth between the at least a pocket lining and the belt in such a way that the additional cloth and the main body are at least partially overlapped on one another;

the additional cloth having a degree of elasticity generally equal to the second value;

fixing the additional cloth and the main body and the belt to one another;

fixing the at least a pocket lining and the additional cloth to one another.

8. A garment provided with a belt made in accordance with the method of claim 1, the garment comprising:

a first plurality of portions of fabric which are obtained from a fabric having a longitudinal extension axis and being formed by braided fibers in such a way as to be perpendicular to one another and free of elastic properties;

the first plurality of portions of fabric having a first plurality of cut lines in turn having an inclined direction (I) of an internal angle, with the weft direction (T) or the warp direction (0), comprised between 30° and 60° and which are coupled to one another so as to define a first strip;

a first elastic strip;

the first strip and the first elastic strip being overlapped on one another and fixed to one another so as to realize a belt;

a main body conformed to at least partially cover the lower limbs of a person wearing the garment, when the garment is worn; the belt and the main body being fixed to one another.

9. The garment of claim 8, further comprising: a second elastic strip; the second elastic strip and the belt being overlapped on one another and fixed to one another.

10. The garment of claim 8, further comprising: at least a pocket lining; the at least a pocket lining, the main body and the belt being fixed to one another.

11. The garment of claim 10, wherein: the at least a pocket lining has a degree of elasticity having a first value; the fabric has a degree of elasticity having a second value; the first value is lower than the second value; it comprises: an additional cloth arranged between the at least a pocket lining and the belt in such a way that the additional cloth and the main body are at least partially overlapped on one another; the additional cloth, the main body and the belt being fixed to one another; the at least a pocket lining and the additional cloth being fixed to one another.

* * * * *